US009706832B2

(12) United States Patent
Price et al.

(10) Patent No.: US 9,706,832 B2
(45) Date of Patent: Jul. 18, 2017

(54) DISPENSERS AND APPLICATOR HEADS THEREFOR

(71) Applicant: The Procter & Gamble Company, Cincinnati, OH (US)

(72) Inventors: Amy Marie Price, Hamilton, OH (US); Gregory Clegg Spooner, Hong Kong (HK); Kin Wong Yau, Hong Kong (HK); Ming Fung Chen, Hong Kong (HK); William Fraser Gwynfor Jones, Ewhurst (GB); David Bernard Domingo Deacon, Hong Kong (HK); Chun Yu Wong, Hong Kong (HK); Wai Keung Tsui, Hong Kong (HK)

(73) Assignee: The Procter & Gamble Company, Cincinnati, OH (US)

( * ) Notice: Subject to any disclaimer, the term of this patent is extended or adjusted under 35 U.S.C. 154(b) by 766 days.

(21) Appl. No.: 14/012,405

(22) Filed: Aug. 28, 2013

(65) Prior Publication Data

US 2014/0064821 A1 Mar. 6, 2014

Related U.S. Application Data

(60) Provisional application No. 61/694,070, filed on Aug. 28, 2012.

(51) Int. Cl.
*A45D 34/04* (2006.01)
*A46B 11/00* (2006.01)
(Continued)

(52) U.S. Cl.
CPC ..... *A46B 11/0041* (2013.01); *A45D 34/04* (2013.01); *A45D 34/042* (2013.01);
(Continued)

(58) Field of Classification Search
CPC ... A46B 11/0041; A46B 11/002; A46B 11/00; A46B 11/0089; A46B 11/0086;
(Continued)

(56) References Cited

U.S. PATENT DOCUMENTS 1,047,878 A * 12/1912 Avery ..... A46B 11/0027 222/390
3,458,263 A * 7/1969 Gibbs ..... A47L 13/26 215/287

(Continued)

*Primary Examiner* — David Walczak
*Assistant Examiner* — Thomas M Abebe

(57) ABSTRACT

An applicator head for selectively dispensing product includes a base structure and a support structure. The base structure includes a top face inclined relative to a bottom face, and a first side wall. The top face includes a base flange, and defines a first orifice in fluid communication with a fastener of the bottom face. The support structure includes a lower face inclined relative to an upper face, and a second side wall. The upper face includes a top surface and defines a second orifice. The lower face includes a support flange engaged with the base flange such that the support structure is pivotable relative to the base structure between first and second positions. Fluid communication is facilitated from the fastener through the second orifice in only one of the first and second positions. A dispenser is also provided.

14 Claims, 19 Drawing Sheets

(51) Int. Cl.

| | |
|---|---|
| ***B05B 1/00*** | (2006.01) |
| ***A47L 13/26*** | (2006.01) |
| ***A47L 13/22*** | (2006.01) |
| ***A46B 5/00*** | (2006.01) |
| *A46B 9/00* | (2006.01) |

(52) U.S. Cl.
CPC ..... *A46B 5/0075* (2013.01); *A46B 11/0086* (2013.01); *A46B 11/0089* (2013.01); *A46B 9/005* (2013.01); *A46B 2200/10* (2013.01); *A46B 2200/1033* (2013.01)

(58) Field of Classification Search
CPC ..... A46B 2200/1033; A45D 34/04; A45D 34/34042; A45D 24/26; A45D 19/02; A47L 13/22; B65D 47/42; B65D 83/00
USPC ..... 132/12; 15/28; 401/286, 269, 129, 401/183–184
See application file for complete search history.

(56) References Cited

U.S. PATENT DOCUMENTS 4,533,273 A * 8/1985 Obata ..... A46B 3/005 401/190
4,963,047 A 10/1990 Trotta
4,974,984 A * 12/1990 Kafkis ..... A45D 34/042 401/186
4,993,859 A * 2/1991 Assad ..... B65D 47/44 401/206
6,109,810 A 8/2000 Flores et al.
6,505,986 B1 * 1/2003 Oder ..... A45D 19/02 222/211
7,722,277 B2 * 5/2010 Byun ..... A45D 34/04 401/202
7,794,168 B2 * 9/2010 Chang ..... A46B 11/0013 401/205
8,262,307 B1 * 9/2012 Cross ..... A46B 11/0041 401/183
8,479,752 B2 * 7/2013 Duffield ..... B65D 83/285 134/104.2
8,893,933 B2 * 11/2014 Ohshima ..... B65D 83/206 222/162
9,220,881 B2 * 12/2015 Kaufman ..... A61M 35/003
2001/0055511 A1 * 12/2001 Baumann ..... A61B 17/20 401/266
2003/0059247 A1 * 3/2003 Kandasamy ..... B65D 47/42 401/184
2003/0194261 A1 * 10/2003 Sanchez ..... A46B 11/0041 401/282
2007/0248402 A1 * 10/2007 Chan ..... A46B 11/0027 401/286
2008/0019762 A1 * 1/2008 Byun ..... A45D 19/02 401/273
2008/0019763 A1 * 1/2008 Kim ..... A45D 34/042 401/281
2008/0138145 A1 * 6/2008 Kwon ..... A45D 34/04 401/266
2008/0167590 A1 * 7/2008 Jon ..... A45D 34/042 601/160
2008/0210251 A1 * 9/2008 Dallianis ..... A45D 24/26 132/116
2009/0180825 A1 * 7/2009 Chang ..... A46B 11/0013 401/129
2009/0184177 A1 * 7/2009 Wu ..... A46B 11/00 239/274
2010/0034574 A1 * 2/2010 Zhang ..... A45D 40/24 401/47
2010/0143021 A1 * 6/2010 De Laforcade ..... A45D 33/00 401/129
2011/0142527 A1 * 6/2011 Kaufman ..... A45D 34/042 401/132
2014/0064821 A1 * 3/2014 Price ..... A46B 11/0041 401/183

* cited by examiner

DISPENSERS AND APPLICATOR HEADS THEREFOR

FIELD OF THE INVENTION

A dispenser includes an applicator head to facilitate selective dispensation of product from the dispenser.

BACKGROUND OF THE INVENTION

Conventional dispensers include an applicator head to facilitate selective dispensation of product from the dispenser.

SUMMARY OF THE INVENTION

In accordance with one embodiment, an applicator head is configured for selectively dispensing product. The applicator head comprises a base structure and a support structure. The base structure includes a bottom face, a top face, and a first side wall. The top face is inclined relative to the bottom face. The bottom face comprises a fastener. The top face comprises a base flange and defines a first orifice. The first orifice is in fluid communication with the fastener. The support structure comprises a lower face, an upper face, and a second side wall. The lower face is inclined relative to the upper face. The upper face comprises a top surface and defines a second orifice. The lower face comprises a support flange engaged with the base flange such that the support structure is pivotable relative to the base structure between a first position and a second position. Fluid communication is facilitated from the fastener through the second orifice in only one of the first position and the second position.

In accordance with another embodiment, a dispenser comprises a container and an applicator head. The container defines a reservoir and comprises a spout. The applicator head comprises a base structure and a support structure. The base structure includes a bottom face, a top face, and a first side wall. The top face is inclined relative to the bottom face. The bottom face comprises a fastener coupled with the spout of the container. The top face comprises a base flange and defines a first orifice. The first orifice is in fluid communication with the fastener. The support structure comprises a lower face, an upper face, and a second side wall. The lower face is inclined relative to the upper face. The upper face comprises a top surface and defines a second orifice. The lower face comprises a support flange engaged with the base flange such that the support structure is pivotable relative to the base structure between a first position and a second position. Fluid communication is facilitated from the reservoir through the second orifice in only one of the first position and the second position.

BRIEF DESCRIPTION OF THE DRAWINGS

While the specification concludes with claims, it is believed that the same will be better understood from the following description taken in conjunction with the accompanying drawings in which:

DETAILED DESCRIPTION OF THE INVENTION

Figure 1A:
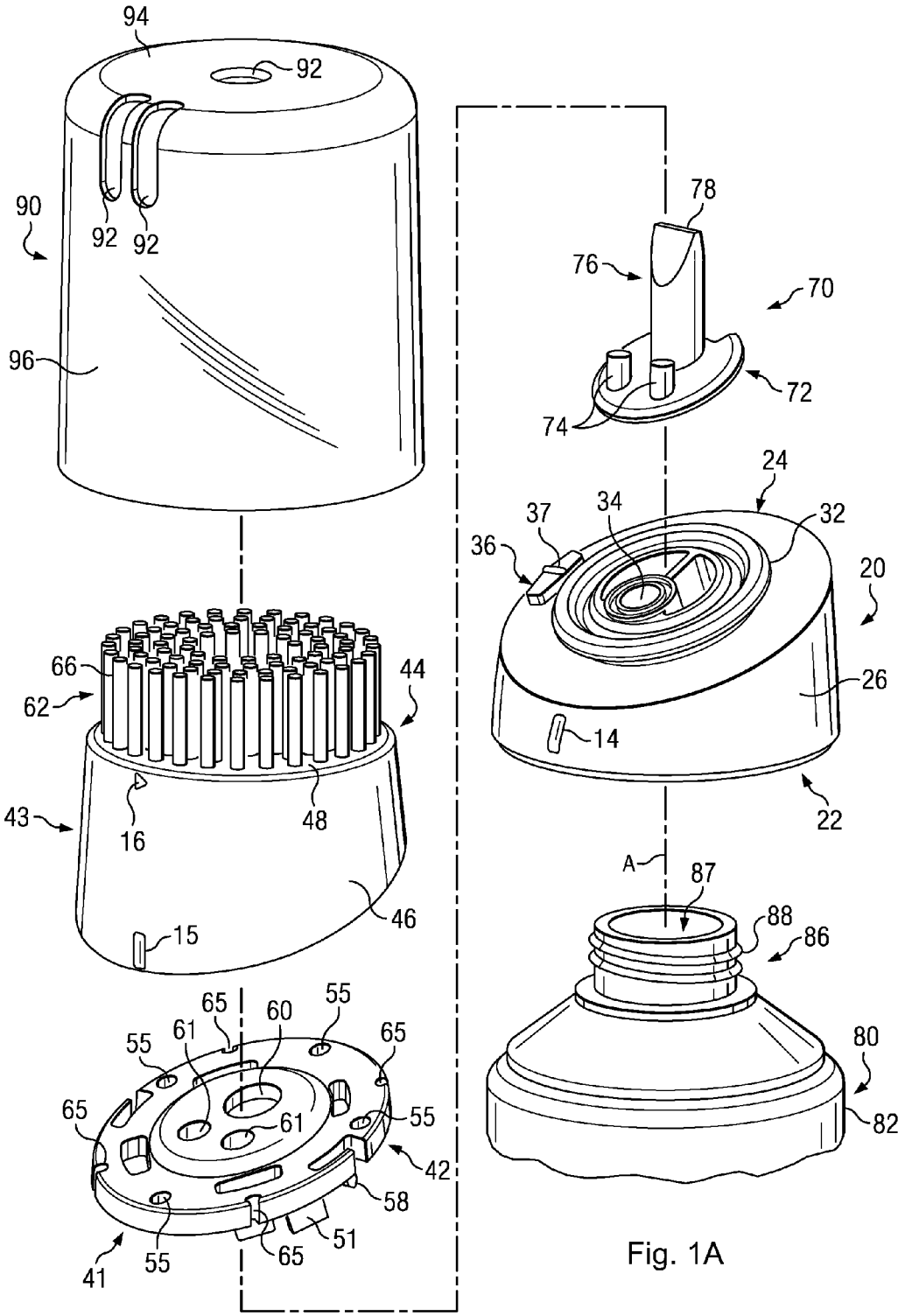
FIG. 1A is an exploded top perspective view depicting portions of a dispenser in accordance with one embodiment.

This application claims priority to U.S. Provisional Application No. 61/694,070 filed Aug. 28, 2012, which is incorporated herein by reference.

Certain embodiments are hereinafter described in detail in connection with the views and examples of FIGS. 1A-1C, 2, 3, 4A-4D, 5A-5B, 6A-6C, 7A-7B, 8A-8C, 9A-9C, and 10A-10F, wherein like numbers illustrate like elements throughout the views.

A dispenser can be configured to contain and selectively dispense a product such as, for example, a personal care product. A personal care product can comprise a lotion, a gel, a cream, or any of a variety of other liquids or other products for use in application to the skin or another part of the human body, such as for facial cleaning or shave preparation. Alternatively, the product might not comprise a personal care product, but might rather comprise a product for use in the care of animals, or a cleaning product such as a home care product or an automobile care product. In one example, the product can comprise a cleansing composition or a surfactant, for example. Dispensers can be provided in any of a variety of suitable configurations.

In one example, with reference to FIGS. 1A-1C, 2, 3, 4A-4D, a dispenser 10 is shown to include a container 80 and an applicator head 12. A product 98 (FIG. 1C), such as a face scrubbing lotion or cream or other personal care product for example, can be disposed within a reservoir 84 defined by a wall 82 of the container 80. In addition to the wall 82, the container 80 can additionally comprise a spout 86. The spout 86 can define a passage 87 in fluid communication with the reservoir 84, and can be configured to facilitate dispensation of the product 98 from the reservoir 84 and the container 80. The spout 86 can include a fastener, such as an internal or external thread for example, to facilitate attachment of the container 80 to an applicator head or cap, as described further below. For example, the spout 86 can include a thread 88, shown to be an external thread. Alternatively, instead of a thread, the spout can define a flange or other mechanical feature designed to selectively or permanently interlock with a corresponding feature of an applicator head or cap.

Figure 1B:
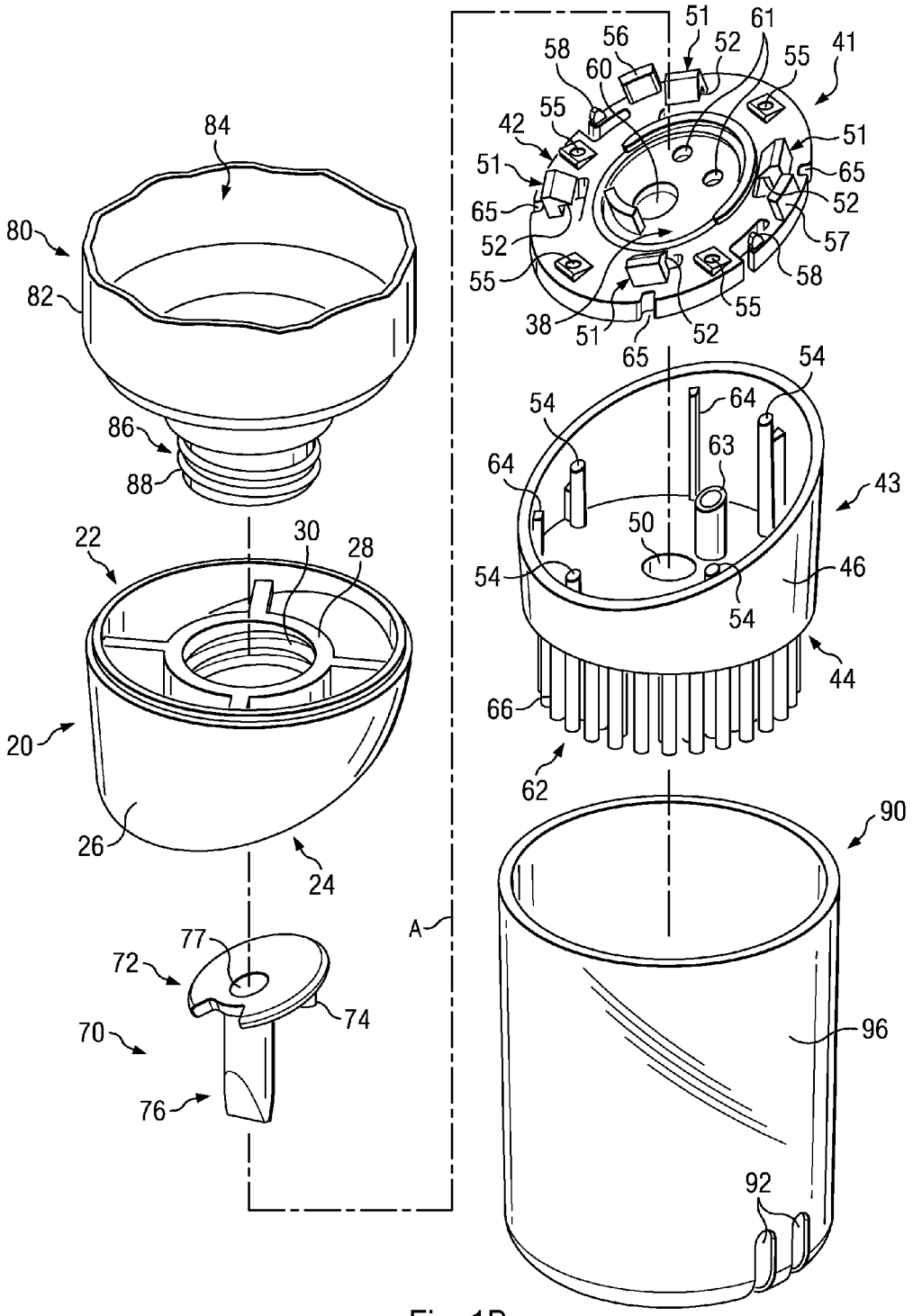
FIG. 1B is an exploded bottom perspective view depicting portions of the dispenser of FIG. 1A.
Figure 1C:
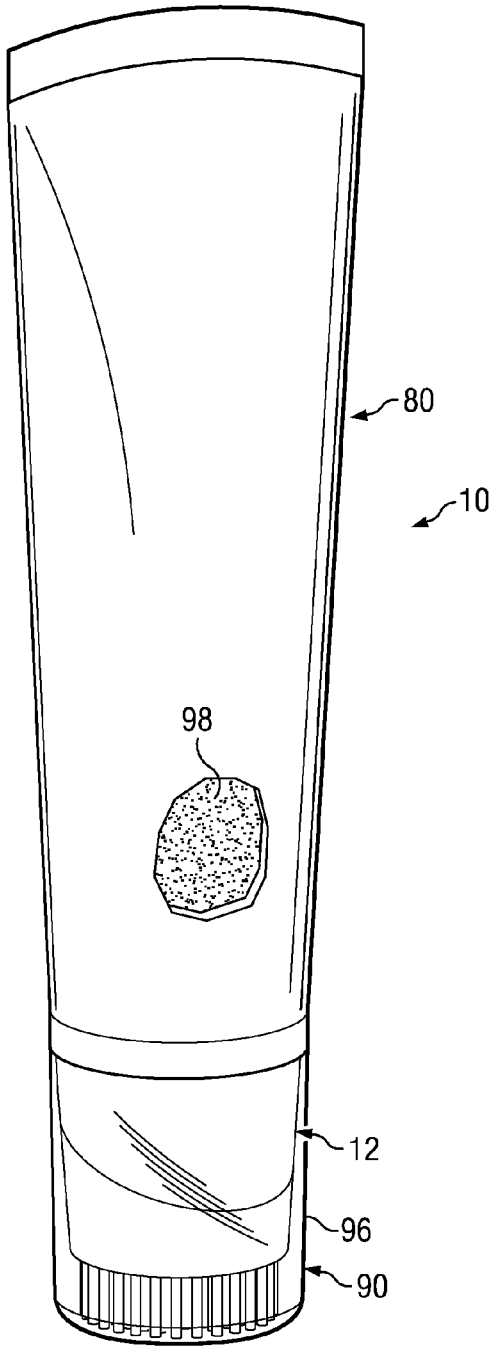
FIG. 1C is a perspective view depicting the dispenser of FIG. 1A as fully assembled, and with a portion of a side wall of a container broken out to illustrate product within the container.
Figure 2:
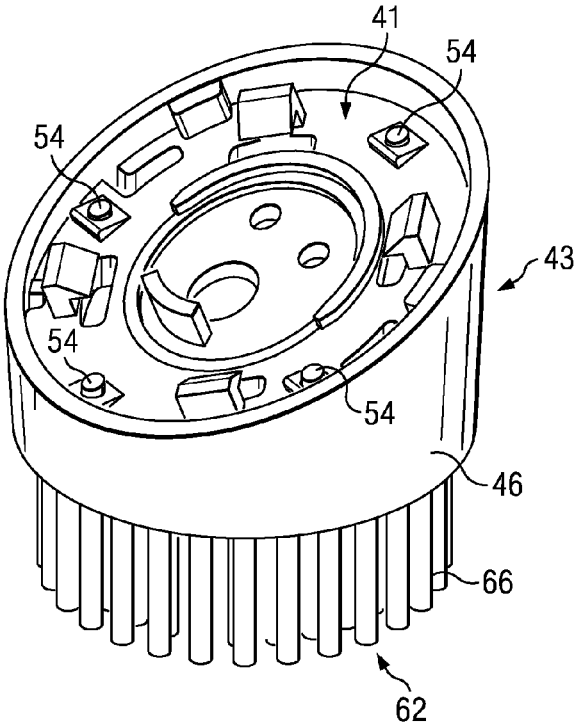
FIG. 2 is a bottom perspective view depicting certain components of an applicator head of the dispenser of FIG. 1A as assembled.

In one embodiment, as shown in FIG. 1C, the container 80 can comprise a deformable tube, such that the container deforms or collapses as the product 98 is released from the reservoir 84. However, in other embodiments, it will be appreciated that a container can be provided in any of a variety of other suitable configurations including, for example, a flexible bag or a rigid bottle.

The dispenser 10 can include an applicator head 12. The applicator head 12 can be coupled with the container 80, as is described further herein, and can be configured to selectively facilitate the dispensation of the product 98 through the passage 87 defined by the spout 86, through the applicator head 12, and from the dispenser 10. Depending upon the position of a portion of the applicator head 12, as described more fully below, dispensation of the product 98 from the dispenser 10 can either be facilitated or prevented. Accordingly, the applicator head 12 can be configured to control or regulate the dispensation of the product 98 from the container 80, and can be used to selectively prevent the product 98 from leaking or otherwise inadvertently escaping from the container 80.

An applicator head can be provided in any of a variety of suitable configurations. In one embodiment, with reference to FIGS. 1A-1C, 2, 3, 4A-4D, the applicator head 12 can include a base structure 20 and a support structure 40. The base structure 40 can include a bottom face, shown generally as 22, that can be configured to about a portion of the container 80. The bottom face 22 is shown to comprise a fastener 28 that can selectively engage the spout 86 of the container 80. For example, the fastener 28 can define a threaded aperture 30 that can threadably engage the spout 86 of the container 80, to facilitate coupling or attachment of the applicator head 12 to the container 80. In other embodiments, a bottom face of a support structure of an applicator head might not define a threaded aperture, but might instead comprise a flange or other mechanical feature designed to selectively or permanently interlock with a corresponding feature of a spout or other portion of a container. It will be appreciated that a fastener of a base structure of an applicator head can be configured in any of a variety of suitable configurations, to accommodate whatever spout diameter and configuration is present on the intended associated container.

The base structure 22 can also include a top face, shown generally as 24, and a side wall 26. The top face 24 is shown to be inclined relative to the bottom face 22, with the side wall extending between the bottom face 22 and the top face 24. The top face 24 can comprise a base flange 32 and can define a orifice 34. The orifice 34 can extend to, and be in fluid communication with, the fastener 28, such that the product 98 can be dispensed from the reservoir 84 of the container 80, through the passage 87 in the spout 86, and into and through the fastener 28 and orifice 34. In one embodiment, as shown in FIGS. 1A-1C, 2, 3, 4A-4D, the base structure 22 can be formed as a unitary structure.

The support structure 40 is shown to include a lower member 41 and an upper member 43 which can be attached to one another in any of a variety of suitable configurations. For example, with reference to FIGS. 1B and 2, the upper member 43 can include a plurality of stanchions 54 and ribs 64. When the lower member 41 is attached to the upper member 43, the ribs 64 can be received within corresponding grooves 65 in the lower member 41, and the stanchions 54 can be received within corresponding apertures 55 in the lower member 41. The ends of the stanchions 54 can then be melted (see FIG. 2) to maintain attachment of the lower member 41 and the upper member 43. The upper member 43 can additionally include one or more supports, such as a support block 63 shown in FIG. 1B, to maintain appropriate spacing and support of the lower member 41 relative to the upper member 43 when attached together. It will be appreciated that lower and upper members of a support structure of an applicator head can be attached in any of a variety of alternative suitable configurations.

The support structure 40 can include a lower face and an upper face, shown generally at 42 and 44, respectively. The lower face 42 can be inclined relative to the upper face 44, and a side wall 46 can extend between the lower face 42 and the upper face 44. The upper face 42 is shown to comprise a top surface 48 and an orifice 50. The lower face 44 can include a support flange 52. In this embodiment, the upper member 43 is shown to comprise the side wall 46, and the lower member 41 is shown to include a plurality of tabs 51 that each define a respective portion of the support flange 52. It will be appreciated, however, that a support flange can be provided in any of a variety of other configurations, and that upper and lower members of a support structure can be provided in any of a variety of alternative embodiments.

Figure 3:
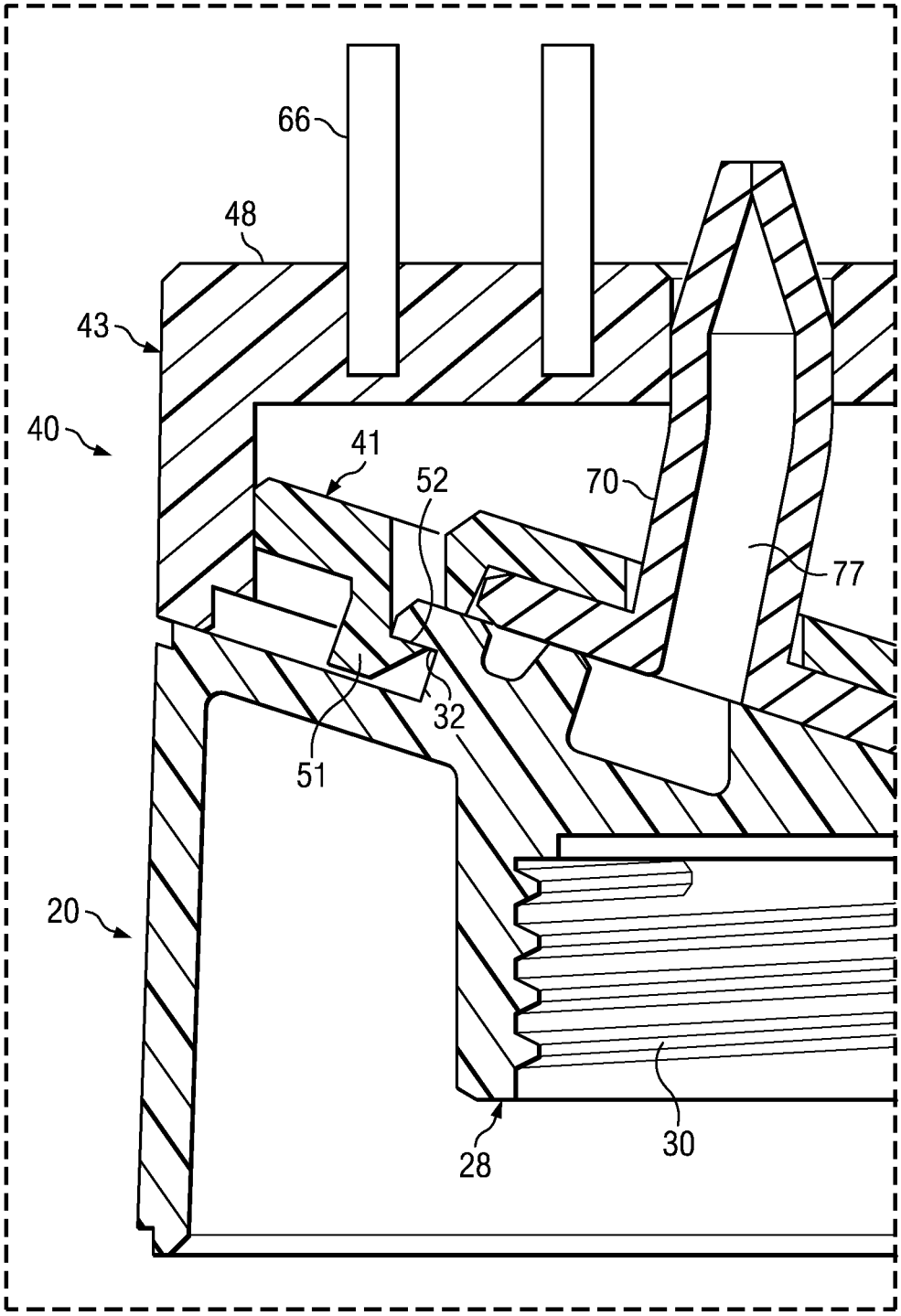
FIG. 3 is an elevational cross-sectional view depicting a portion of the applicator head of FIG. 1A as assembled and with a support structure in a closed position.
Figure 4A:
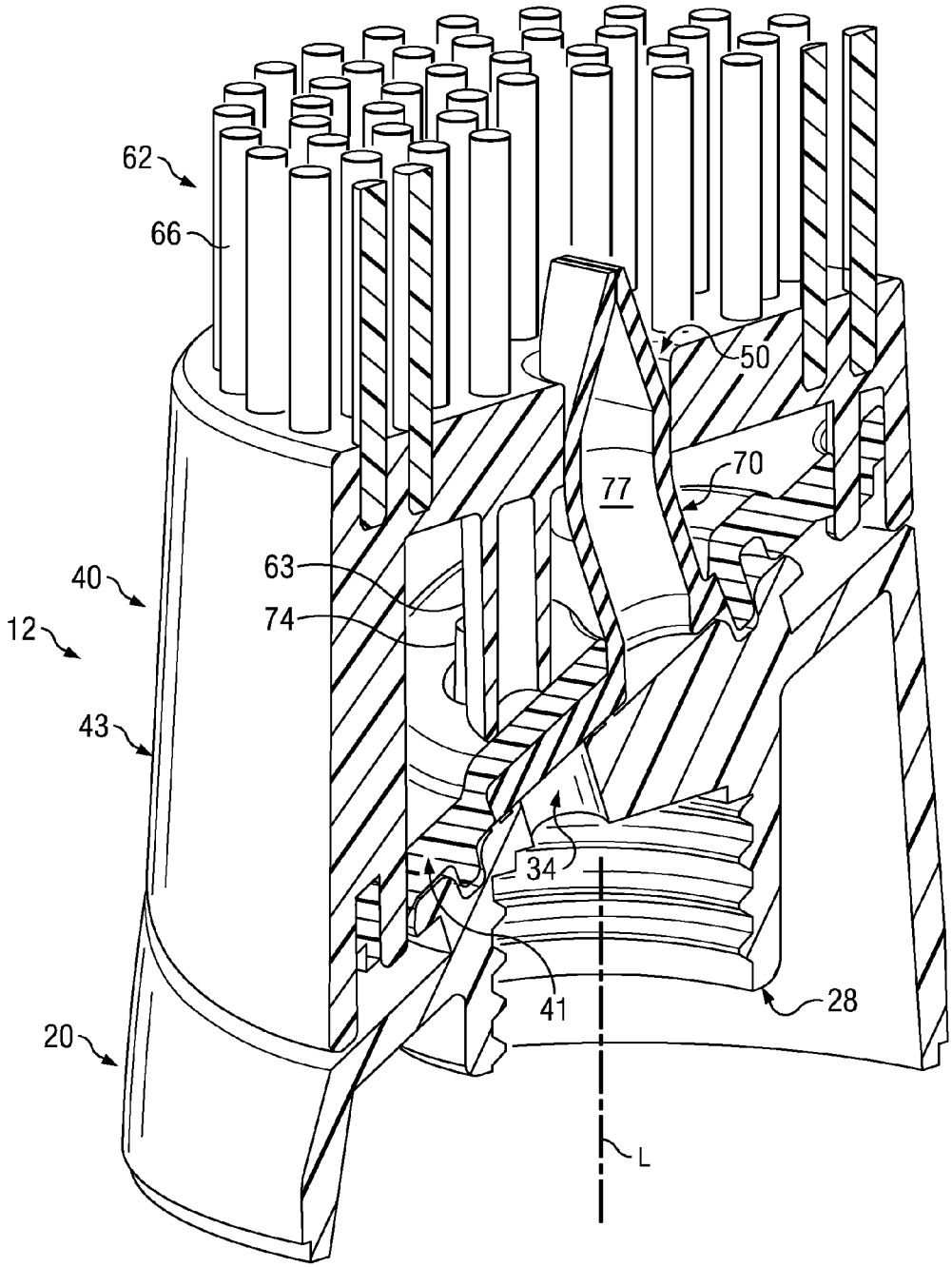
FIG. 4A is a perspective view depicting a cross-section of the applicator head of FIG. 3.
Figure 4B:
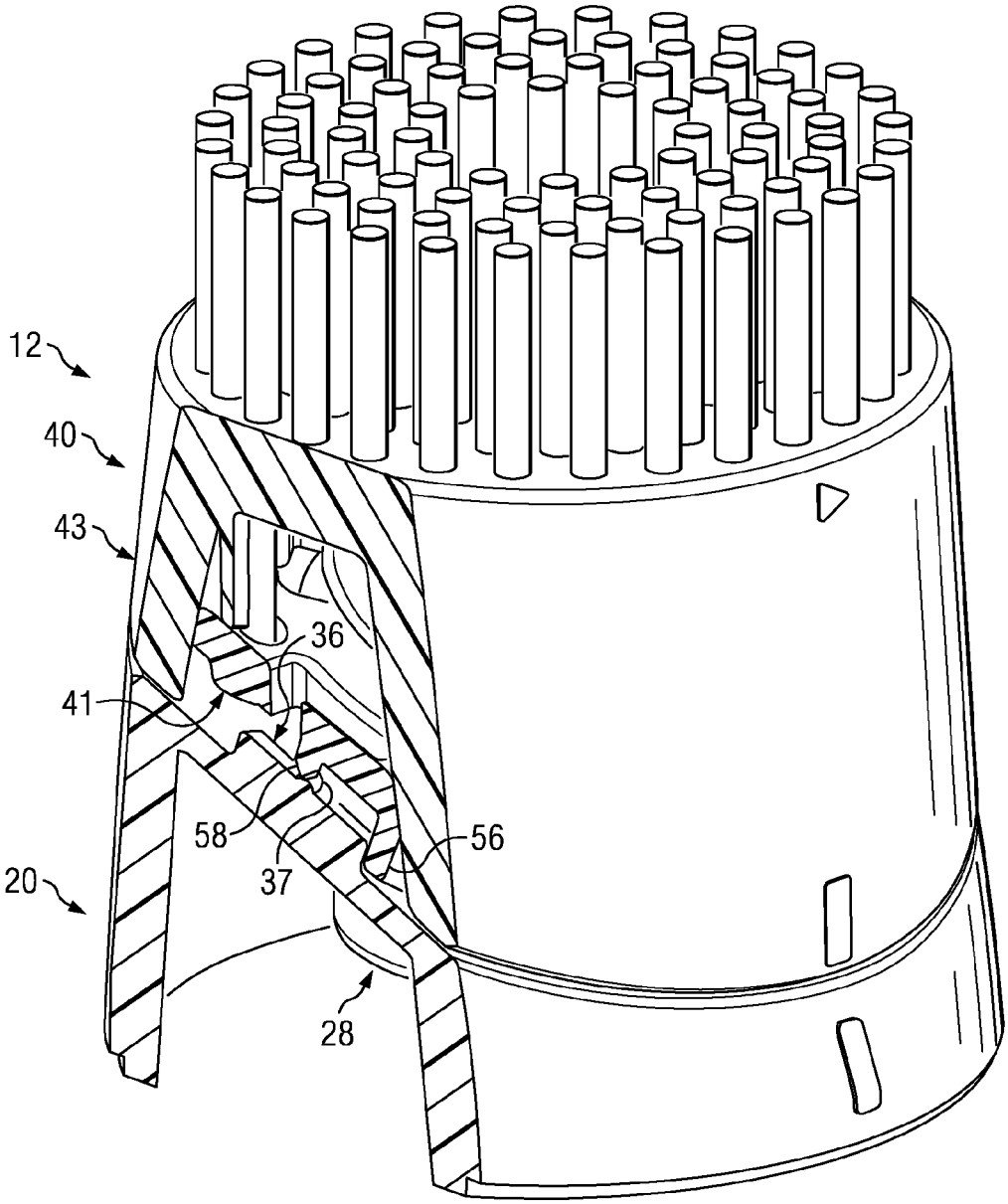
FIG. 4B is a perspective view depicting the applicator head of FIG. 4A with a portion cut away for clarity of illustration.
Figure 4C:
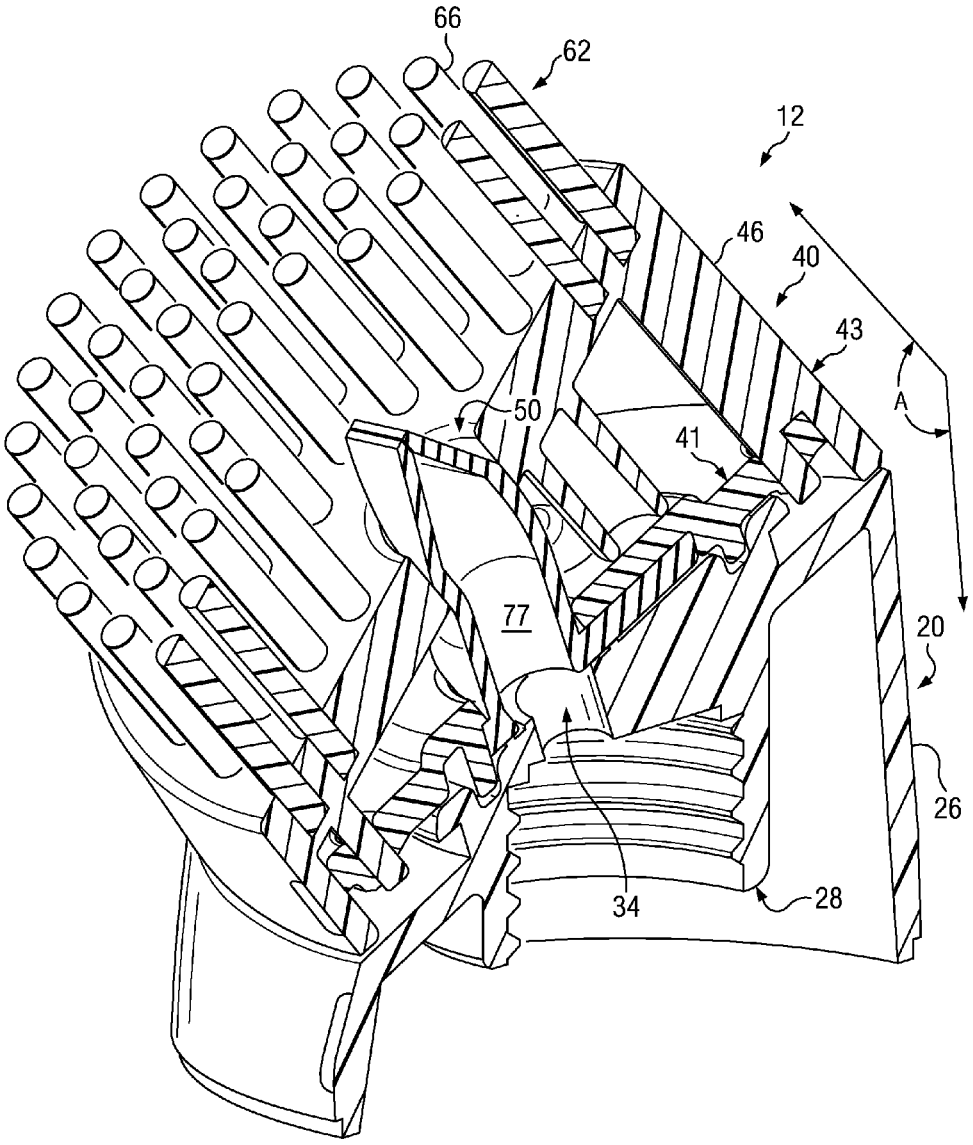
FIG. 4C is a perspective view depicting a cross-section of the applicator head of FIG. 3, but with the support structure in an opened position.

The support flange 52 can be engaged with the base flange 32 of the base structure 20 as shown in FIG. 3, such that the support structure 40 is pivotable relative to the base structure 20 between a first position and a second position. In one embodiment, fluid communication is facilitated from the fastener 28 and through the orifices 34 and 50, in only one of the first position and the second position. For example, in the first position as shown in FIG. 4A, fluid communication is not provided from the fastener 28 through the orifice 50. But, in the second position as shown in FIG. 4C, fluid communication is facilitated from the fastener 28 through the orifice 50. The support structure 40 is shown to rotate relative to the base structure 40 in a counter-clockwise direction (when viewing the top surface 48 head on) from the first position to the second position, to facilitate dispensation of the product 98 from the reservoir 84 and through the applicator head 12. The support structure 40 is shown to rotate relative to the base structure 40 in a clockwise direction (when viewing the top surface 48 head on) from the second position to the first position, to prevent dispensation of the product 98 from the reservoir 84 and through the applicator head 12. It will be appreciated that an applicator head can alternatively be configured such that these directions of rotation are reversed.

The applicator head 12 can additionally include a valve structure. For example, in one embodiment, with reference to FIGS. 1A-1C, 2, 3, 4A-4D, a valve structure 70 is shown to comprise a base member 72 and an elongated tube member 76 extending from the base member 72, and to define a passage 77. The tube member 76 can define an aperture opposite the base member 72, in fluid communication with the passage 77. For example, the valve structure 70 is shown to comprise a duckbill valve formed from rubber or some other resilient material, with the aperture being in the form of an elongate slit 78. It will be appreciated, however, that a valve structure might not comprise a duckbill valve, but might rather comprise a diaphragm valve, ball-check valve (with or without spring), hinged or swing type valve, a lift check valve, or some other form of check-type valve, or might not include any check-type feature.

The lower face 42 of the support structure 40 can define a recess 38 that at least partially receives the base member 72 of the valve structure 70, such that the tube member 76 extends through an aperture 60 in the lower member 41 of the support structure 40, and into the orifice 50. In one embodiment, the tube member 76 can extend through the orifice 50 and beyond the top surface 48 of the upper face 44, as shown in FIG. 3. In another embodiment, a tube member might not extend beyond a top surface of an upper face of a support structure. Whether and to what extent the tube member 76 protrudes beyond the top surface 48, and how far the tube member 76 extends from the top surface 48 as compared with the extension of an application structure 62 from the top surface 48 (less, equivalent, or more), can be selected depending upon the intended use of the dispenser 10, the composition of the product 98, and various product application characteristics (e.g., whether lather of the product 98 is desired upon application).

The base member 72 can define prongs 74 which can be received within respective corresponding apertures 61 in the lower member 41 of the support structure 40, which alone and/or together with other features, can assist in rotationally restraining the valve structure 70 relative to the support structure 40. In this configuration, as can be seen in FIGS. 3, 4A, and 4C, the base member 72 of the valve structure 70 can be sandwiched between, and in contacting engagement with each of, the base structure 20 and the lower member 41 of the support structure 40. When the support structure 40 is in the first position relative to the base structure 20 as shown in FIG. 4A, the orifice 34 can be misaligned with the passage 77 in the tube member 76, the base member 72 can block the orifice 34, and fluid can thereby be prevented from being dispensed from the reservoir 84 through the applicator head 12. However, when the support structure 40 is in the second position relative to the base structure 20 as shown in FIG. 4C, the passage 77 of the tube member 76 can be aligned with the orifice 34 and can assist in facilitating fluid communication from the fastener 28 through the orifice 50.

The applicator head 12 can be configured such that the degree of rotation of the support structure 40 relative to the base structure 20, such as in moving from the first position to the second position, can be limited (e.g., to 180°). This limitation can be provided through use of any of a variety of suitable structures. For example, in one embodiment, the top face 24 of the base structure 20 can include a positional boss (e.g., 36), and the lower face 42 of the support structure 40 can include a stop boss (e.g., including portions 56 and 57). Each of the first and second positions are defined through contact of the positional boss 36 with the stop boss (e.g., including portions 56 and 57). More particularly, with reference to FIG. 4B, the first position is shown to be defined through contact of the positional boss 36 with portion 56 of the stop boss. Further, with reference to FIG. 4D, the second position is shown to be defined through contact of the positional boss 36 with portion 57 of the stop boss.

The applicator head 12 can additionally be provided with one or more mechanical features that provide a desired amount of resistance or friction between the base structure 20 and the support structure 40 during part or all of the range of rotation of the support structure 40 relative to the base structure 20. This can be provided to reduce any likelihood of inadvertent rotation of the support structure 40, to provide a desired tactile feel to a user, and/or to maintain the support structure 40 in place once rotated into one or both of the first and second positions. An example of such mechanical features include a bump 37 provided on the positional boss 36, and a prong 58 provided by the lower member 41 of the support structure 40, which can selectively interact with one another as shown for example in FIGS. 4B and 4D. The height of the bump 37 and the prong 58 relative to one another, and the stiffness of the prong 58, can affect the amount of rotational friction present between the base structure 20 and the support structure 40. In another embodiment (not shown), multiple bumps or other features can be provided to provide a notched feel or audible clicking during rotation of the support structure relative to the base structure.

Figure 6A:
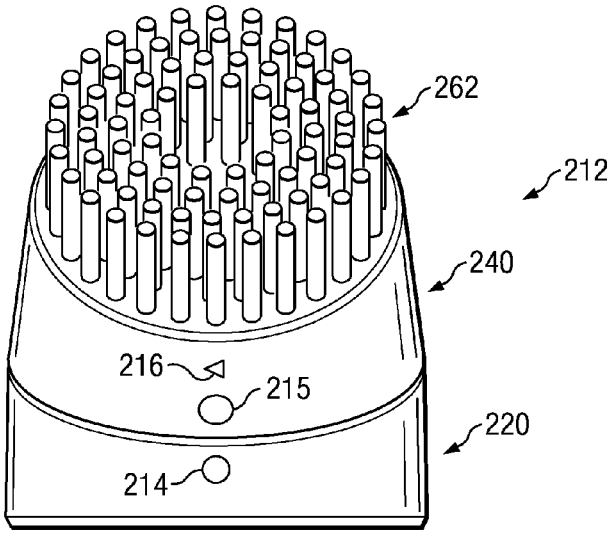
FIG. 6A is a front elevational view depicting an applicator head in accordance with yet another embodiment, with a support structure in a first position.
Figure 6B:
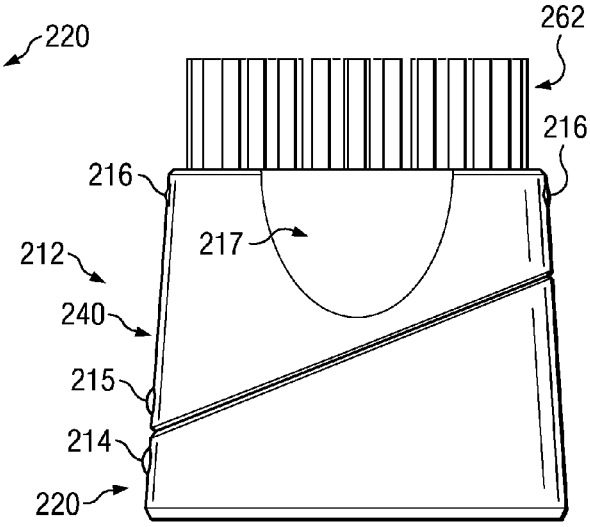
FIG. 6B is a side elevational view depicting the applicator head of FIG. 6A, but with the support structure in a second position.
Figure 6C:
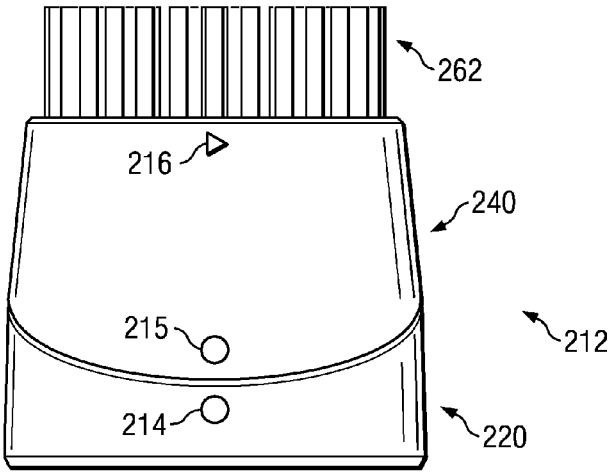
FIG. 6C is a rear elevational view depicting the applicator head of FIG. 6B.

Indicia can be provided on one or both of the base structure 20 and the support structure 40. A user of the dispenser can see and/or feel the indicia to determine whether the base structure is in the first position or the second position. See, for example, the alignment tabs 14 and 15 in FIG. 1A that can be molded into or applied to the base structure 20 and the support structure, respectively. Indicia can additionally or alternatively be provided to indicate the direction for rotation of the support structure 40 relative to the base structure 20 from the first position to the second position. See, for example, the directional arrow 16 in FIG. 1A that can be molded into or applied to the support structure 40. It will be appreciated that indicia can be provided in any of a variety of other suitable configurations. For example, FIGS. 6A-6C illustrate an applicator head 212 having a base structure 220, a support structure 240, and an application structure 262, and can in many ways be similar to the applicator head 12 described above, except for example with respect to the selection and configuration of certain indicia, such as for example alignment tabs 214 and 215 and directional arrow 216. Additionally, the support structure 240 of the applicator head 212 is shown in FIG. 6B to define a recess area or notch 217 to facilitate ease of gripping and turning of the support structure 240 relative to the base structure 220 by a user. It will be appreciated that an applicator head can include indicia, recess areas, or notches in any of a variety of other suitable configurations.

Figure 8A:
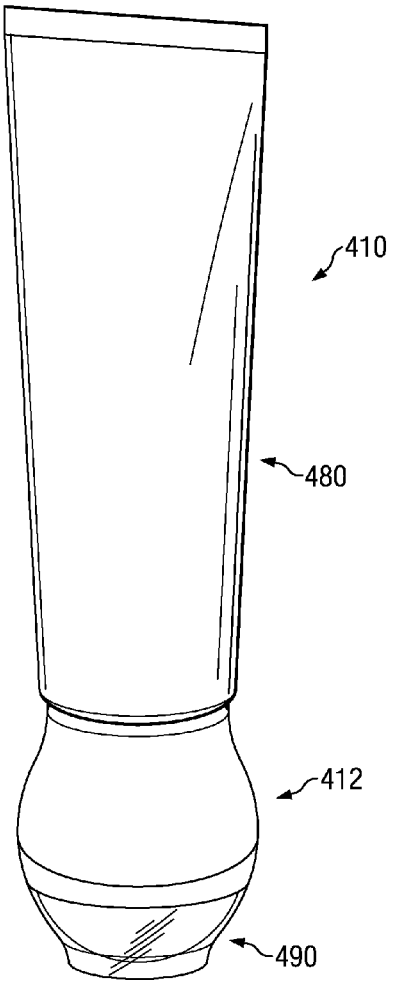
FIG. 8A is a perspective view depicting a dispenser in accordance with yet another embodiment, with a support structure in a first position.
Figure 8B:
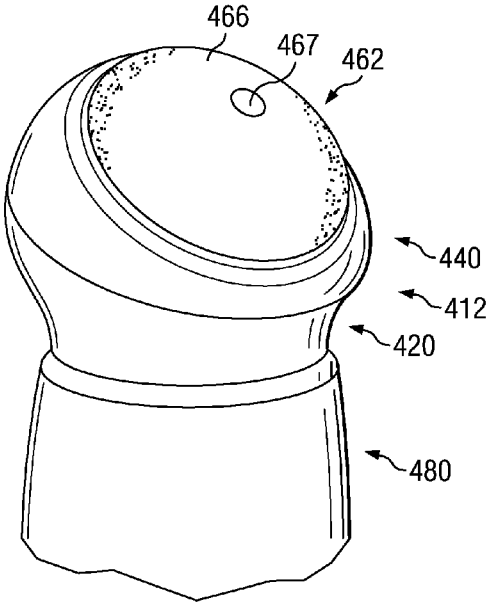
FIG. 8B is an enlarged perspective view depicting a portion of the dispenser of FIG. 8A, with a protective cap removed for clarity of illustration, and with the support structure in a second position.
Figure 8C:
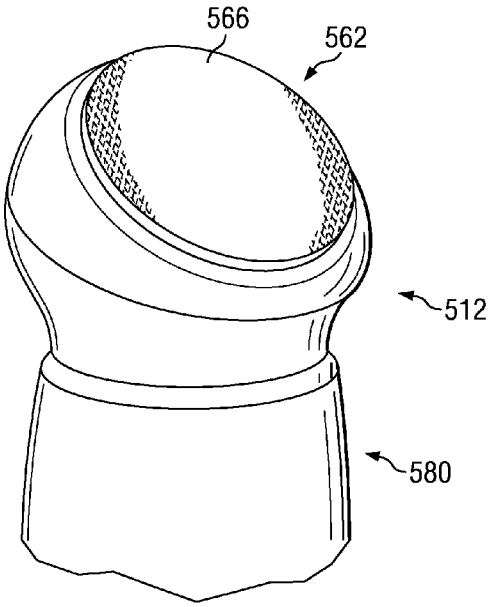
FIG. 8C is a perspective view depicting a portion of a dispenser in accordance with still another embodiment.

Referring again to FIGS. 1A-1C, 2, 3, 4A-4D, the applicator head 12 can also include the application structure 62 extending from the top surface 48 of the support structure 40. In one embodiment, as shown in FIGS. 1A-1C, 2, 3, 4A-4D, the application structure 62 can comprise a plurality of polymeric fingers, tufts of bristles or filaments, and/or other type of elastomeric or flexible fingers 66, or combinations thereof, that extend from the top surface 48 of the support structure 40 at locations surrounding the orifice 50, in a density suitable for the intended use of the dispenser 10, and that can cooperate to form a brush or other cleaning implement, for example. The application structure 62 can be formed from foam, sponge, non-woven fibers, woven fibers, or a combination thereof. In alternative embodiments, an application structure might not comprise flexible fingers, but might rather comprise a different type of structure(s). For example, an applicator head 412 is shown in FIG. 8B to include an application structure 462 comprising a sponge 466. In one embodiment, the sponge 466 can define an aperture 467 to facilitate dispensation of product through an orifice (not shown) in a top surface of a support structure 440 of the applicator head 412. As another example, an applicator head 512 is shown in FIG. 8C to be coupled with a container 580 and to include an application structure 562 comprising a fabric material 566. In one embodiment, product from the container 580 can be dispensed through an orifice (not shown) in a top surface of a support structure of the applicator head 512, and beneath the fabric material 566, to permeate through the fabric material 566 and onto the skin or other work surface during use of the dispenser by a user.

Referring again to the example of FIGS. 1A-1C, 2, 3, 4A-4D, the application structure 62 is shown to be permanently attached to the support structure 40. However, in alternative embodiments, an application structure can be removably attached to a support structure, such that a user can selectively remove and replace an application structure (e.g., to replace a worn application structure, or to facilitate substitution with a different type of application structure such as replacement of a brush-type allocation structure with a sponge-type application structure). Or, alternatively, a portion of a support structure to which an application structure is attached, can be configured to be selectively removed and replaced along with the application structure (as a single unit or module) by a user.

The side walls 26, 46 can have a generally circular or ovular cross-sectional shape, for example. Though, in other embodiments, it will be appreciated that side walls of an applicator head can have different cross-sectional shapes. In the first position, the side walls 26, 46 can be generally aligned with one another, with the bottom face 22 being generally parallel (e.g., within 5° of parallel) with the upper face 44 and generally perpendicular to a longitudinal axis "L" (FIG. 4A) defined by the fastener 28 of the base structure 20, and can cooperate to a define a barrel shape, as generally shown in FIGS. 1C and 4A-4B. However, in other embodiments, when in the first position, the respective side walls of a base structure and a support structure can cooperate to define a different shape, such as a sphere shape or a tulip shape, with the side walls being generally aligned with one another, and with a bottom face of the base structure being generally parallel with an upper face of the support structure and generally perpendicular to a longitudinal axis defined by the fastener of the base structure. It will be appreciated that the sphere shape and the tulip shape can provide a smoother or more streamlined appearance and feel of the applicator head when in the first and/or second positions.

Figure 7A:
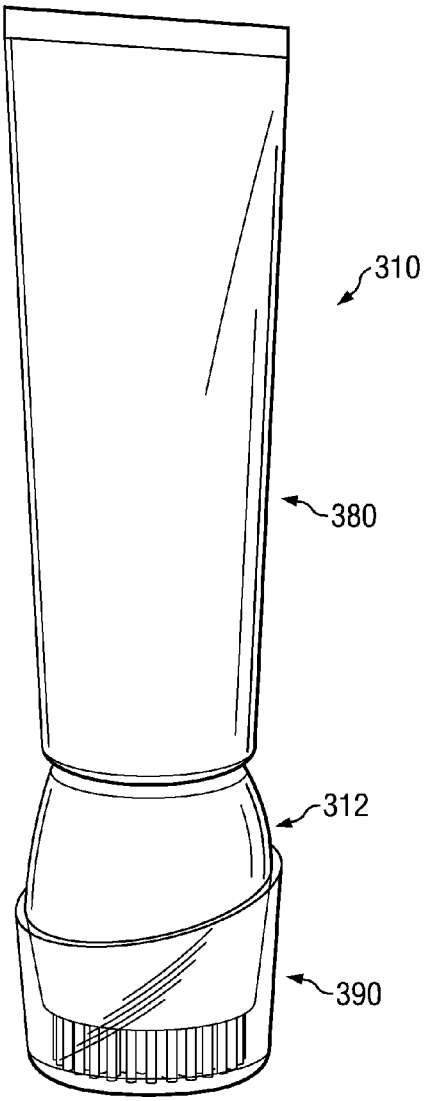
FIG. 7A is a perspective view depicting a dispenser in accordance with another embodiment, with a support structure in a first position.
Figure 7B:
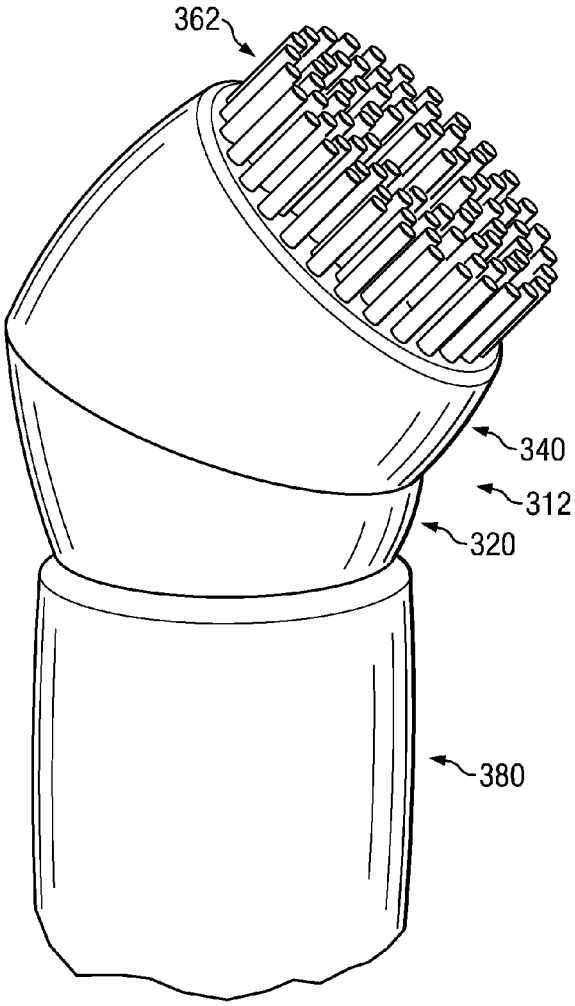
FIG. 7B is an enlarged perspective view depicting a portion of the dispenser of FIG. 7A, with a protective cap removed for clarity of illustration, and with the support structure in a second position.
Figure 9A:
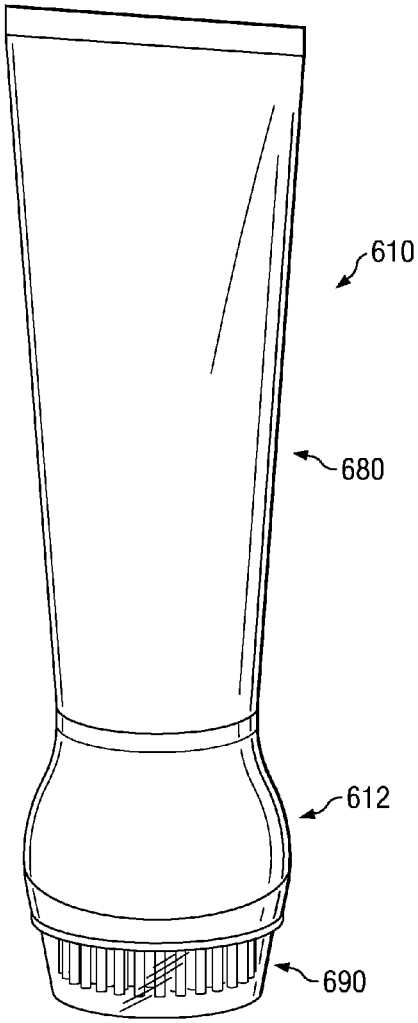
FIG. 9A is a perspective view depicting a dispenser in accordance with still another embodiment, with a support structure in a first position.
Figure 9B:
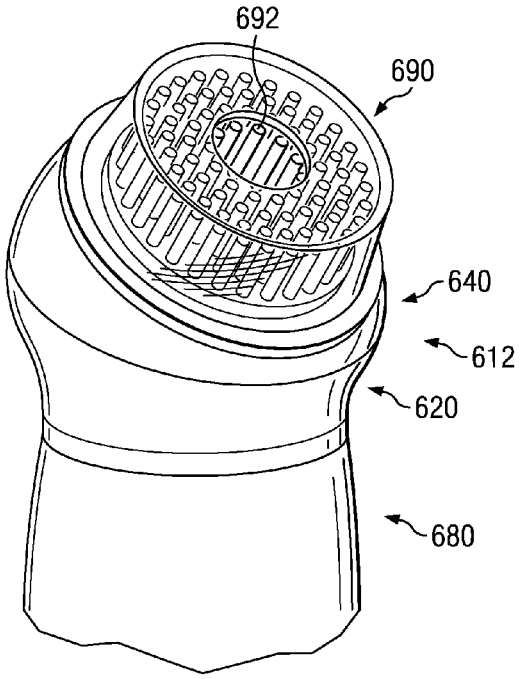
FIG. 9B is an enlarged perspective view depicting a portion of the dispenser of FIG. 9A, with the support structure in a second position.
Figure 9C:
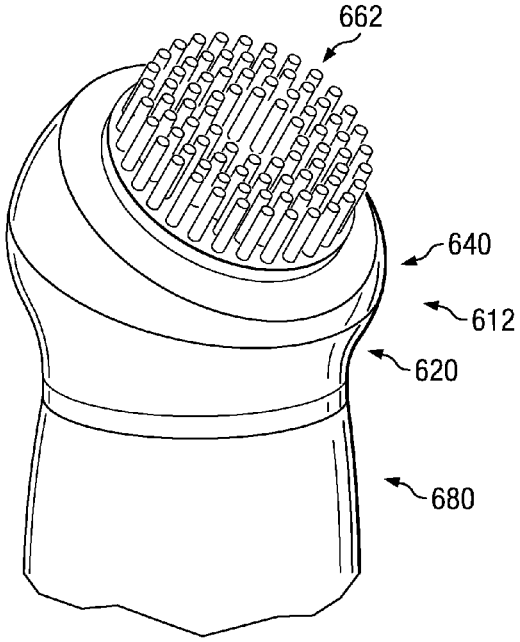
FIG. 9C is a perspective view depicting the portion of the dispenser of FIG. 9B, with the protective cap removed.

FIGS. 7A-7B illustrate a dispenser 310 that includes an applicator head 312, a container 380, and a protective cap 390, with the applicator head 312 including a base structure 320, a support structure 340, and an application structure 362, and with the respective side walls of the base structure 320 and the support structure 340 cooperating to define a tulip shape in the first position (FIG. 7A). FIGS. 8A-8B illustrate a dispenser 410 that includes an applicator head 412, a container 480, and a protective cap 490, with the applicator head 412 including a base structure 420, a support structure 440, and an application structure 462, and with the respective side walls of the base structure 420 and the support structure 440 cooperating to define a sphere shape in the first position (FIG. 8A). Respective side walls of base and support structures of the applicator head 512 of FIG. 8C can also define a sphere shape. FIGS. 9A-9C illustrate a dispenser 610 that includes an applicator head 612, a container 680, and a protective cap 690, with the applicator head 612 including a base structure 620, a support structure 640, and an application structure 662, and with respective side walls of the base structure 620 and the support structure 640 cooperating to define a sphere shape in the first position (FIG. 9A).

Figure 4D:
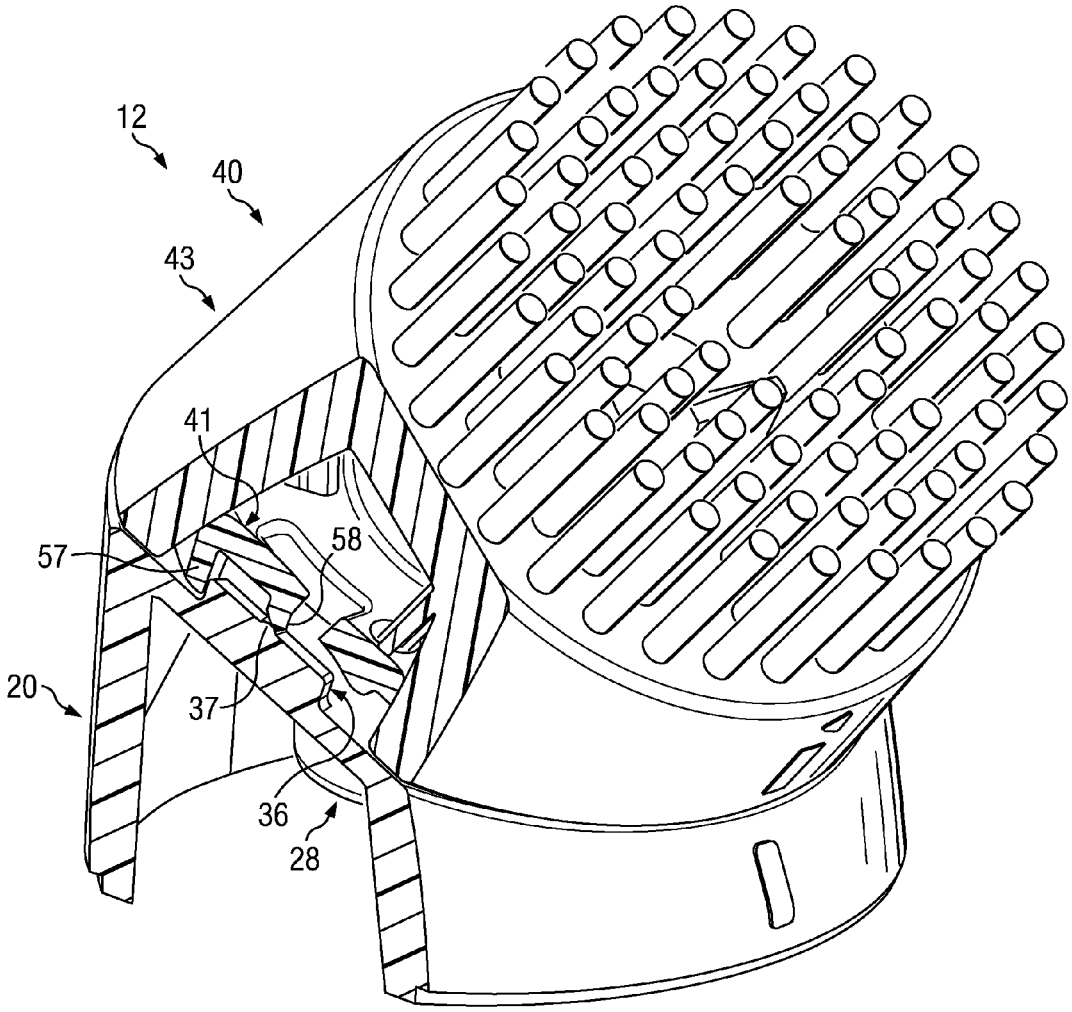
FIG. 4D is a perspective view depicting the applicator head of FIG. 4C with a portion cut away for clarity of illustration.

When in the second position, side walls of respective base and support structures might not be generally aligned with one another, and an upper face of the support structure might not be generally parallel with a bottom face of the base structure and might not be generally perpendicular to a longitudinal axis defined by a fastener of the base structure, as for example shown with respect to the applicator head 12 in FIGS. 4C-4D. For example, with reference to FIG. 4C, when in the second position, the side walls 26, 46 of the respective base and support structures 20, 40 can form an angle "A" relative one another of between about 90° and about 170°. Alternatively, the angle A can be between about 90° and about 160°, or between about 90° and about 150°, or between about 90° and about 140°, or between about 90° and about 130°, or between about 90° and about 120°, or between about 90° and about 110°, or between about 90° and about 100°, or between about 100° and about 170°. Alternatively, the angle A can be between about 120° and about 150°, or can be about 135°. In moving from the first position to the second position, the top surface 48 of the support structure 40 can have an angular change of greater than 10°, 20°, 30°, or 40°, for example.

Figure 5A:
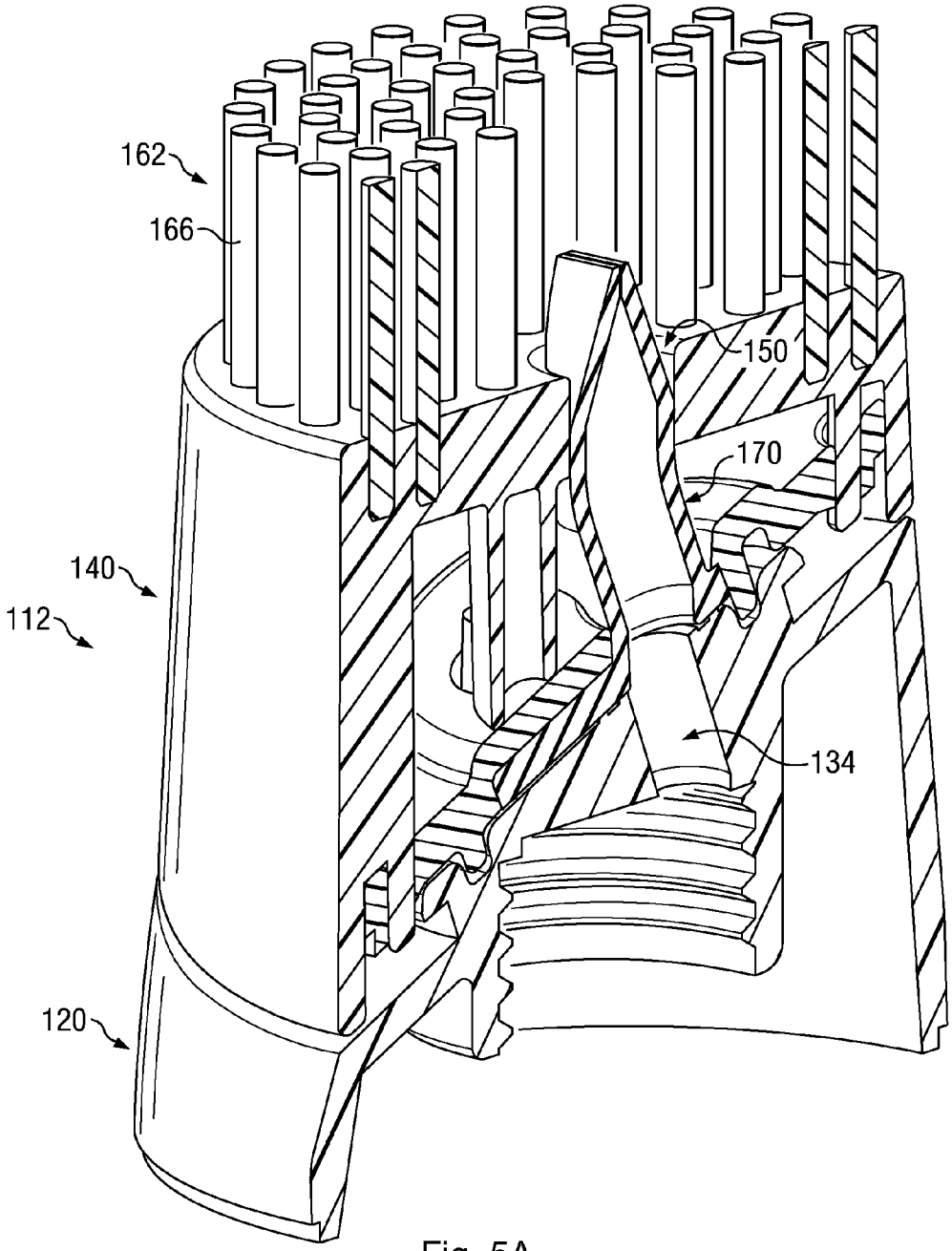
FIG. 5A is a perspective view depicting a cross-section of an applicator head in accordance with another embodiment, with a support structure in an opened position.
Figure 5B:
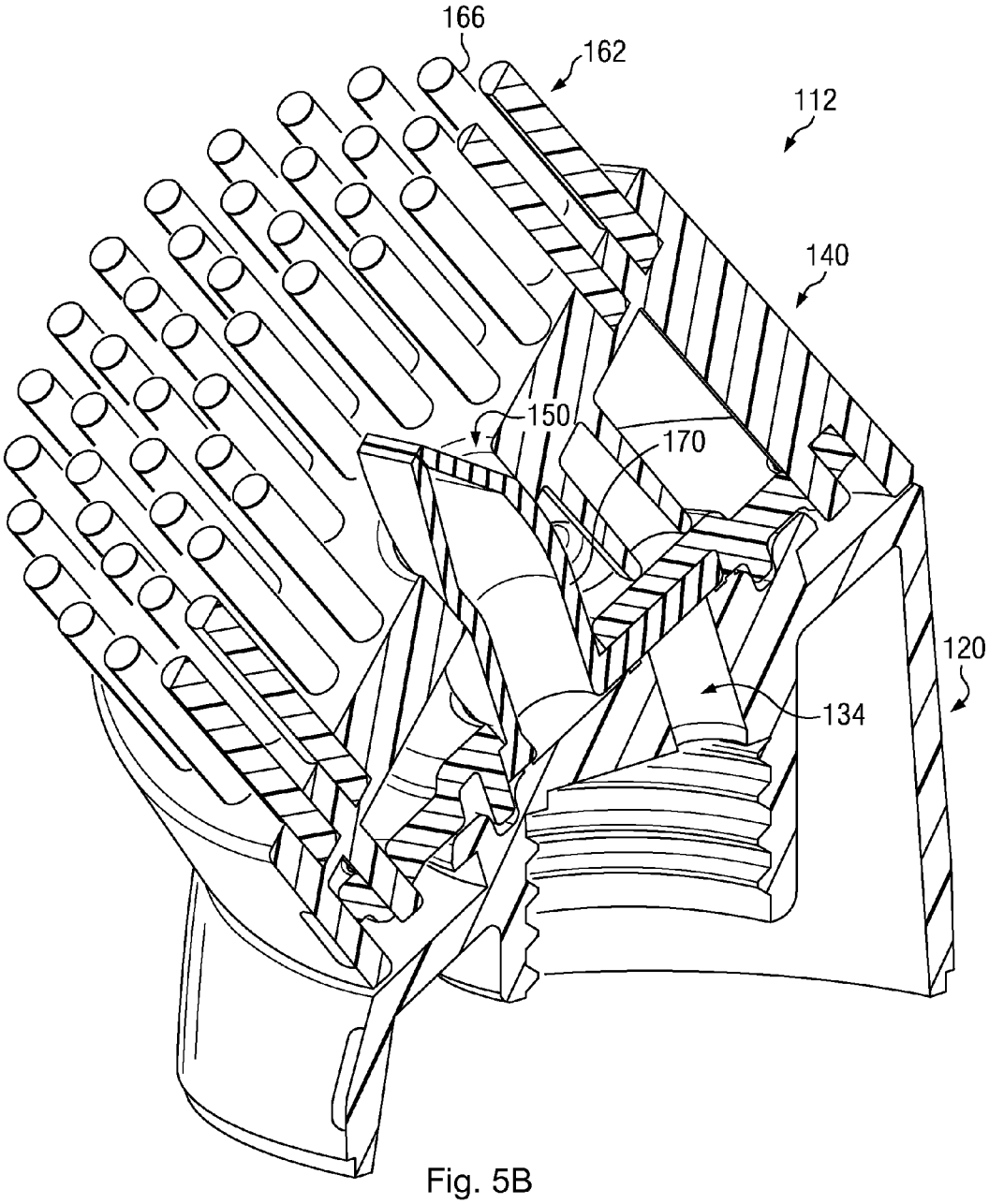
FIG. 5B is a perspective view depicting a cross-section of the applicator head of FIG. 5A, but with the support structure in a closed position.

While the applicator head 12 is described above to facilitate dispensation in the second or non-aligned position (e.g., FIG. 4C) but not in the first or aligned position (e.g., FIG. 4A), it will be appreciated that, alternatively, an applicator head can be configured to facilitate dispensation in the first or aligned position but not in the second or non-aligned position. An example of such an embodiment is shown in FIGS. 5A-5B, wherein an applicator head 112 includes a base structure 120, a support structure 140, a valve structure 170, and an application structure 162 (including flexible fingers e.g., 166), and can be in many ways similar to the applicator head 12 described above, except for example that respective orifices 134, 150 in the base structure 120 and the support structure 140 are positioned to facilitate dispensation in the first or aligned position (FIG. 5A) but not in the second or non-aligned position (FIG. 5B).

Referring again to FIGS. 1A-1C, 2, 3, 4A-4D, the dispenser 10 can additionally include a removable protective cap 90, such as shown in FIG. 1. The protective cap 90 can include a flat top surface 94 and an annular side wall 96 depending from the flat top surface 94. One or more openings (e.g., 92) can be provided in the flat top surface 94 and/or the annular side wall 96, such as to facilitate drainage of moisture from the applicator head 12 during periods of non-use and storage and resultant drying of the application structure 62. The protective cap 90 can be selectively attached to the applicator head 12 and/or the container 80 such as in an interference fit or through some other arrangement, for covering the applicator head 12 when the support structure 40 is in the first position as generally shown in FIG. 1C. It will be appreciated that a protective cap can be provided in any of a variety of other suitable configurations. When the support structure 40 is in the first position and the protective cap 90 is applied to the applicator head 12, it will be appreciated that the dispenser 10 can be stably positioned on the flat top surface 94 of the protective cap 90 as generally shown in FIG. 1C. However, if the protective cap 90 is applied to the applicator head 12 when the support structure 40 is in the second position, it will be appreciated that the dispenser 10 might not be capable of being stably positioned on the flat top surface 94 of the protective cap 90. A protective cap can be provided in any of a variety of suitable alternative configurations, such as for example, are shown of the protective cap 390 in FIG. 7A, the protective cap 490 in FIG. 8A, or the protective cap 690 (having opening 692) in FIGS. 9A-9B.

Referring again to FIGS. 1A-1C, 2, 3, 4A-4D, it will be appreciated that the applicator head 12 can enable a user of the dispenser 10 to selectively control or regulate the dispensation of the product 98 from the container 80. Additionally, the applicator head 12 can facilitate use of the dispenser 10 as a scrub brush, an applicator pad, or other application device (e.g., through use of the application structure 62). Furthermore, due to the ability of the support structure 40 to move relative to the base structure 20, a user can adjust the position of the support structure 40 to achieve certain ergonomic benefits during use of the dispenser 10 to dispense the product 98 and/or as an application device. The applicator head 12 can achieve this combined functionality, but in a simple, low-cost, aesthetically pleasing, simple-to-operate, and space efficient configuration.

FIGS. 10A-10D and 10F illustrate an applicator head 712 and a protective cap 790 in accordance with another embodiment, and that can be suitable for use with a container having a threaded spout (like 80 in FIG. 1). Many features of the applicator head 712 can be configured and function similarly to the applicator head 12 described above, though other features are different as can be appreciated with references to FIGS. 10A-10D and 10F and the following. The protective cap 790 can be configured to selectively engage the applicator head 712 in a snap-fit or otherwise. The applicator head 712 is shown to include a support structure 740 that is pivotally coupled with a base structure 720. More particularly, the base structure 720 is shown to include a bottom member 721 and a top member 723, and the support structure 740 is shown to comprise a lower member 741 and an upper member 743. The bottom member 721 is shown to define a side wall 726, and to comprise a bottom face 722 and a fastener 728 (e.g., including one or more threads 730). The base structure 720 can also comprise a top face 724 that is inclined relative to the bottom face 722, and that can be provided by the bottom member 721 or the top member 723, or through cooperation of the bottom member 721 and the top member 723. The lower member 741 is shown to comprise a side wall 746, and the upper member 743 is shown to comprise an upper face 744. The support structure 740 can also comprise a lower face 742 that is inclined relative to the upper face 744, and that can be provided by the lower member 741 or the upper member 743, or through cooperation of the lower member 741 and the upper member 743.

An application structure 762 (e.g., including bristles 766 and 767) can be attached to the upper member 743 of the support structure 740 through use of any of a variety of known techniques, including for example tufting processes, and can extend from a top surface 748 of the upper member 743. Some of the bristles (e.g., 766) are shown to be located radially outwardly of other ones of the bristles (e.g., 767), relative to an orifice 750 formed in the upper member 743, and to have a height relative to the top surface 748 greater than that of the other ones of the bristles (e.g., 767). This variation or disparity in height of the bristles relative to the top surface 748 can facilitate effective collection and presentation of product dispensed from a container associated with the applicator head 712. For example, shorter bristles disposed radially inwardly can define a platform upon which dispensed product (e.g., cream) can rest until ready for application. It will be appreciated that bristles or other flexible fingers of an application structure can be provided in varying heights and/or other varying dimensions or characteristics in any of a variety of other suitable configurations.

Figure 10A:
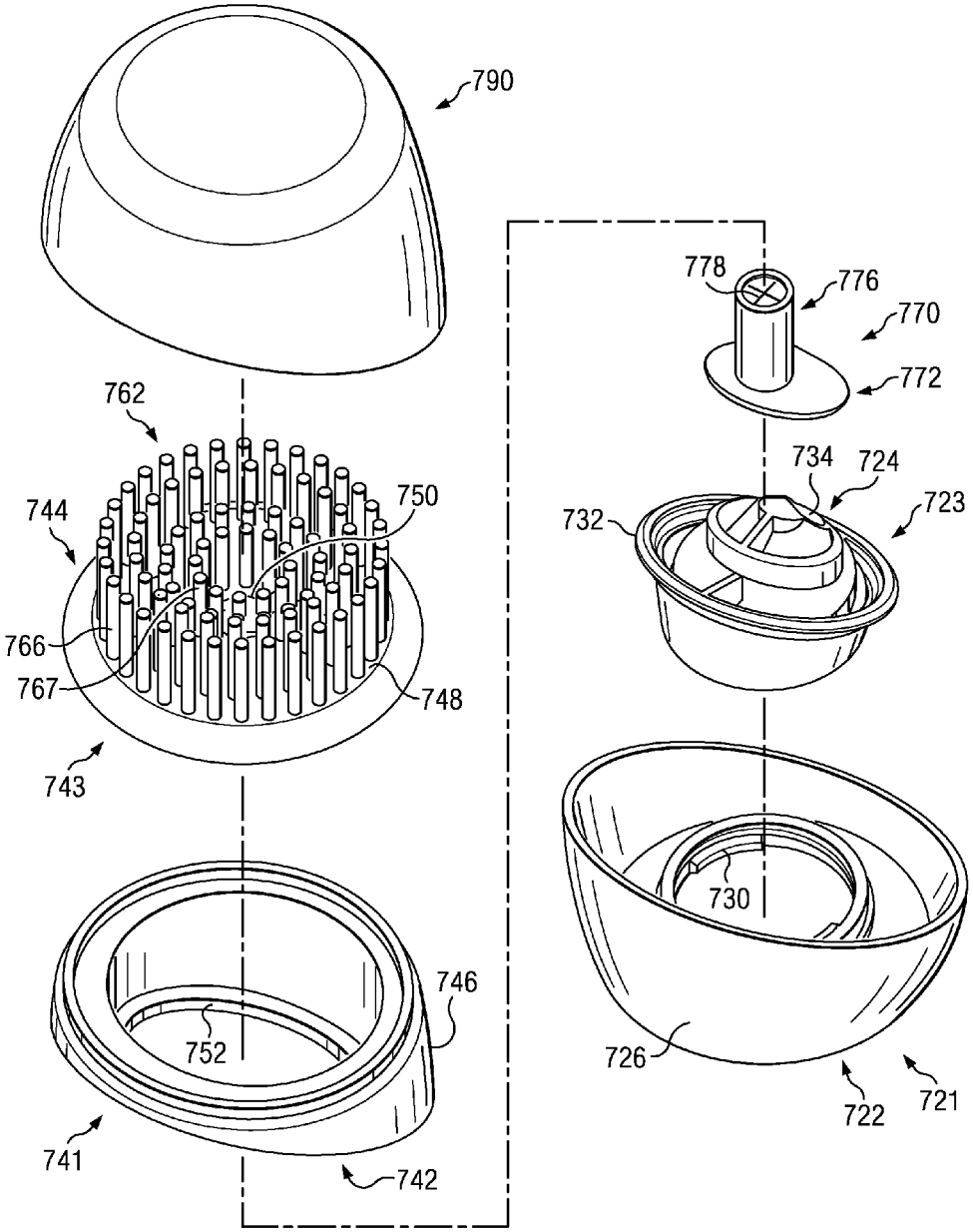
FIG. 10A is an exploded top perspective view depicting an applicator head and a protective cap in accordance with another embodiment.
Figure 10B:
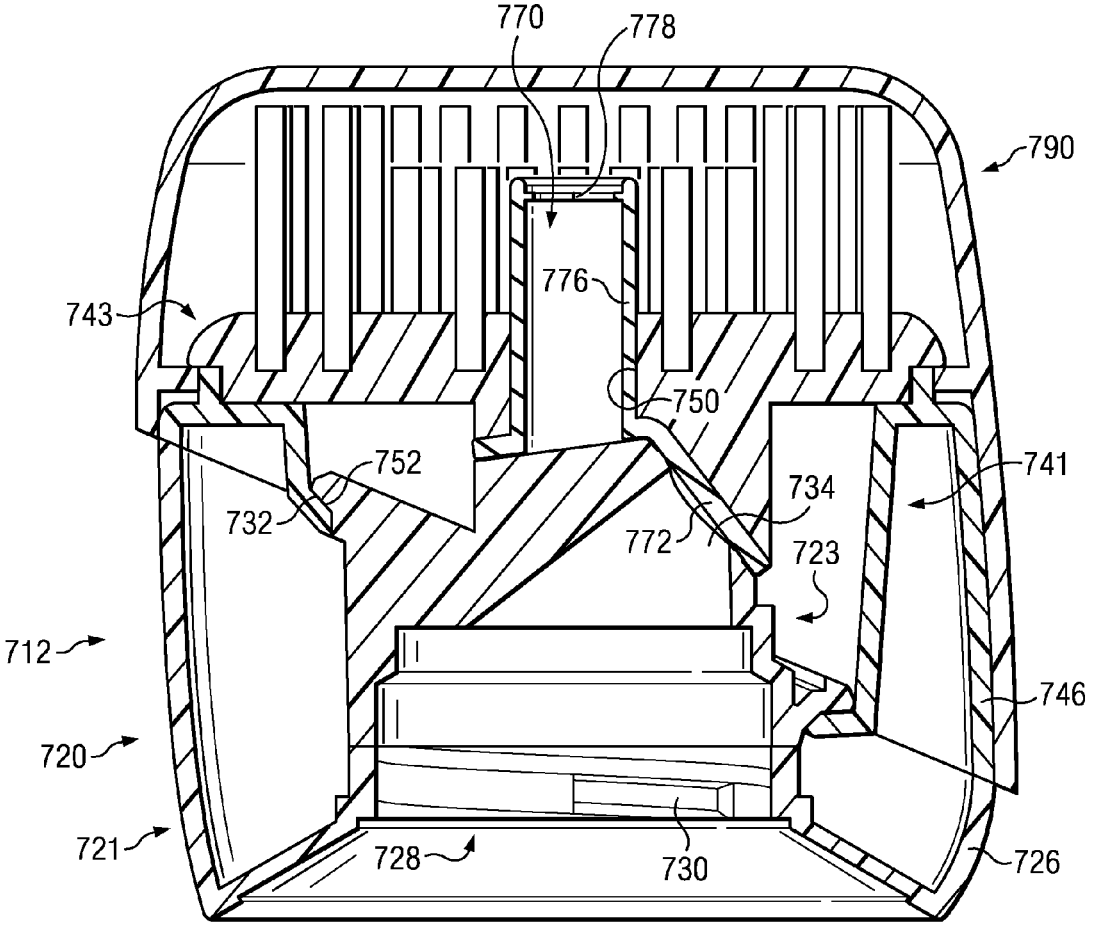
FIG. 10B is an elevational cross-sectional view depicting the applicator head and the protective cap of FIG. 10A as assembled, and with a support structure of the applicator head in a closed position.
Figure 10C:
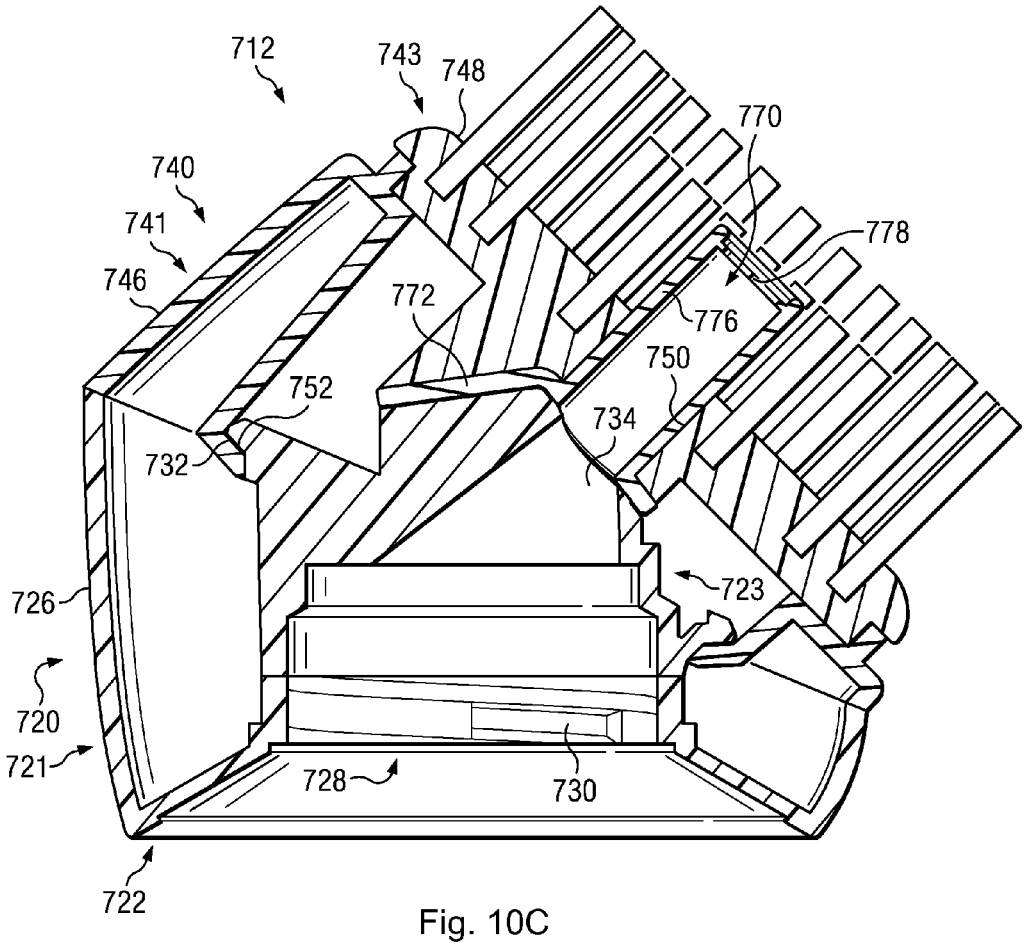
FIG. 10C is an elevational cross-sectional view depicting the applicator head of FIG. 10A as assembled, with the protective cap of FIG. 10A removed and not shown, and with the support structure of the applicator head in an opened position.

The top face 724 of the base structure 720 is shown in FIGS. 10A-10C to comprise a base flange 732 and to define an orifice 734. The lower face 742 of the support structure 740 is shown to comprise a support flange 752 that is engaged with the base flange 732 such that the support structure 740 is pivotable relative to the base structure 720 between a first position and a second position, wherein fluid communication is facilitated through the applicator head 712 in only one of the first position and the second position.

Figure 10D:
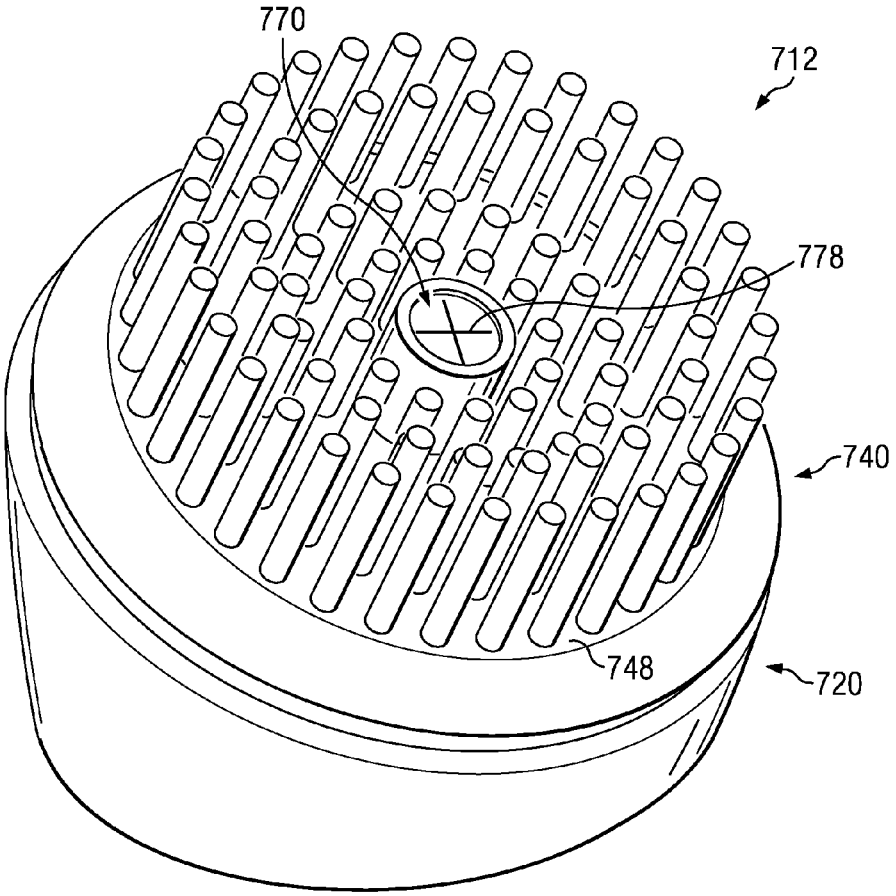
FIG. 10D is a top perspective view depicting the applicator head of FIG. 10C.
Figure 10E:
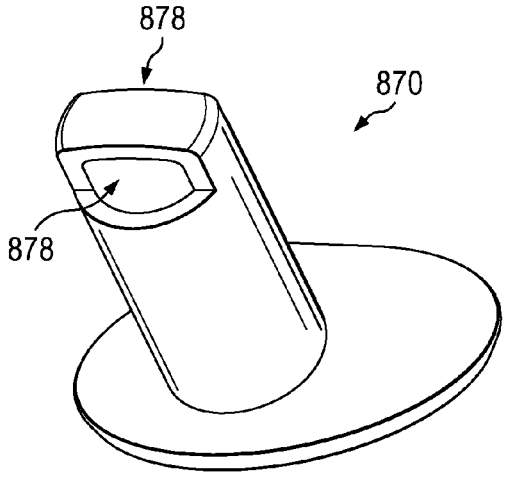
FIG. 10E is a top perspective view depicting a valve structure in accordance with another embodiment.

To assemble the applicator head 712, the top member 723 can be inserted through an aperture defined by the support flange 752, and attached to the bottom member 721, such as with an adhesive and/or a mechanical connection (e.g., a snap-fit), so that the support flange 752 engages the base flange 732. A valve structure 770 and the upper member 743 of the support structure 740 can then be provided, with the upper member 743 attached to the lower member 741, such as with an adhesive and/or a mechanical connection (e.g., a snap-fit). A base member 772 of the valve structure 770 can be sandwiched between, and be in contacting engagement with each of, the top member 723 and the upper member 743, as shown in FIGS. 10B-10C. A tube member 776 of the valve structure 770 can extend through the orifice 750 in the upper member 743 and can define a diaphragm-type valve having an opening 778 that has a normally closed configuration, as best shown in FIG. 10D. A valve structure can be provided in any of a variety of other configurations. For example, in one alternative embodiment, as shown in FIG. 10E, a valve structure 870 can include a tube member that defines one or more openings (two openings 878 shown) that are normally open.

Figure 10F:
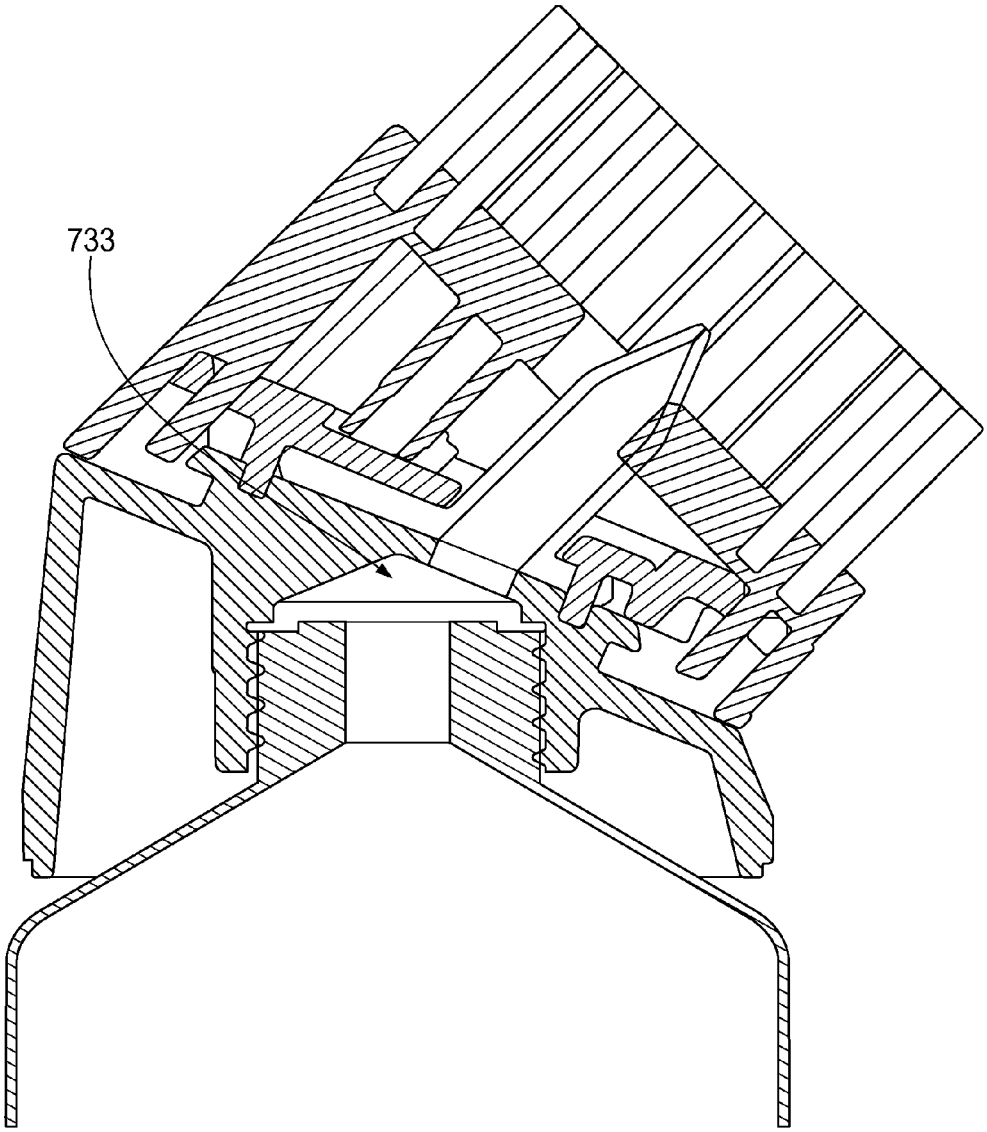
FIG. 10F is an elevational cross-sectional view depicting the applicator head of FIG. 10A as assembled, with the protective cap of FIG. 10A removed and not shown, and with the support structure of the applicator head in an opened position.

Referring again to the embodiment of FIGS. 10A-10D, the top member 723 can define a conically-shaped valve seat as generally shown. In addition, the top member 723 can define a cone shaped valve seat 733 as shown in FIG. 10F. A cone shaped valve seat 733 can allow for easier dispensing of thicker products i.e. the consumer does not have to apply large amounts of force to dispense the product. Once the applicator head 712 is assembled, when in a closed or first position, as shown in FIG. 10B, the base member 772 of the valve structure 770 is shown to block the aperture 734, thereby preventing communication of product through the applicator head 712. However, when in an opened or second position, as shown in FIG. 10C, a passage defined by the tube member 776 of the valve structure 770 can be aligned with the aperture 734, to facilitate communication of product through the applicator head 712. The portion of the dispensation passageway defined by the top member 723, and leading from the fastener 728 to the opening 734, can be generally conically-shaped, as shown in FIGS. 10B-10C, to minimize the force required to effect its passage of product. In one embodiment, the diaphragm-type valve of the valve structure 770 can allow dispensation of product (e.g., cream) with minimal restriction, can allow intake of air into the container to re-inflate the container after product is dispensed, and can substantially prevent leakage of product through the applicator head 712 when the dispenser is upside-down and in the opened or second position. In addition, the applicator head can contain a clicking mechanism to help alert the consumer to when the head is completely closed to help prevent product leakage or in the introduction of water into the product during bathing. It can also help ensure the correct usage pressure by alerting the user to the fully open position.

It will be appreciated that the various components of an applicator head can be formed from any of a variety of suitable materials. In one example, the base structure, support structure, and protective cap can be formed from a rigid plastic, metal, or other material, with a valve structure (e.g., 70) formed from rubber or another resilient material. However, it will be appreciated that any of a variety of other suitable materials can be provided as appropriate for a particular product and application.

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An applicator head configured for selectively dispensing product, the applicator head comprising:

a base structure comprising a bottom face, a top face, and a first side wall, the top face inclined relative to the bottom face, the bottom face comprising a fastener, the top face comprising a base flange and defining a first orifice, the first orifice being in fluid communication with the fastener; and a support structure comprising a lower face, an upper face, and a second side wall, the lower face inclined relative to the upper face, the upper face comprising a top surface and defining a second orifice, the lower face comprising a support flange engaged with the base flange such that the support structure is pivotable relative to the base structure between a first position and a second position, wherein fluid communication is facilitated from the fastener through the second orifice in only one of the first position and the second position; and further comprising a valve structure, the valve structure comprising a base member and an elongated tube member extending from the base member, the tube member extends into the second orifice and defines an aperture opposite the base member, wherein the valve is a duckbill valve or a diaphragm valve.

2. The applicator head of claim 1 wherein:

in the first position, fluid communication is not provided from the fastener through the second orifice;

in the second position, fluid communication is facilitated from the fastener through the second orifice;

the support structure comprises an upper member and a lower member attached to the upper member; and the upper member comprises the upper face.

3. The applicator head of claim 1 wherein the tube member extends through the second orifice and beyond the top surface of the upper face.

4. The applicator head of claim 1 wherein the upper member comprises the second side wall, and wherein the lower member comprises the support flange.

5. The applicator head of claim 4 wherein the base member of the valve structure is sandwiched between, and in contacting engagement with each of, the base structure and the lower member of the support structure.

6. The applicator head of claim 1 wherein the lower member comprises the second side wall and the support flange.

7. The applicator head of claim 6 wherein:

the base structure comprises a top member and a bottom member attached to the top member;

the top member defines the first orifice;

the bottom member defines the first side wall and the bottom face; and the base member of the valve structure is sandwiched between, and in contacting engagement with each of, the top member of the base structure and the upper member of the support structure.

8. The applicator head of claim 1 further comprising an application structure extending from the top surface of the support structure, wherein the application structure extends from the top surface of the support structure at locations surrounding the second orifice.

9. The applicator head of claim 8 wherein the application structure comprises a plurality of flexible fingers.

10. The applicator head of claim 8 wherein the application structure comprises a sponge.

11. The applicator head of claim 1 wherein, in the first position, the first side wall cooperates with the second side wall to define one of a barrel shape, a sphere shape, and a tulip shape.

12. The applicator head of claim 1 wherein:

the top face further comprises at least one positional boss;

the lower face further comprises at least one stop boss; and each of the first position and the second position are defined through contact of said positional boss with said stop boss.

13. The applicator head of claim 1 wherein in the first position, the bottom face is generally parallel with the upper face.

14. The applicator head of claim 1 wherein:

in the first position, the first side wall is generally aligned with the second side wall; and in the second position, the first side wall is not generally aligned with the second side wall.

* * * * *